US007697707B2

(12) United States Patent
Akino

(10) Patent No.: US 7,697,707 B2
(45) Date of Patent: Apr. 13, 2010

(54) CAPACITOR MICROPHONE UNIT

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1042 days.

(21) Appl. No.: 11/195,762

(22) Filed: Aug. 3, 2005

(65) Prior Publication Data

US 2006/0045293 A1 Mar. 2, 2006

(30) Foreign Application Priority Data

Aug. 31, 2004 (JP) ..... 2004-252178

(51) Int. Cl.
*H04R 25/00* (2006.01)

(52) U.S. Cl. ..... 381/369; 381/174; 381/175; 381/361

(58) Field of Classification Search ..... 381/174, 381/178, 179, 355, 357, 361, 369
See application file for complete search history.

(56) References Cited

U.S. PATENT DOCUMENTS 7,171,012 B2 * 1/2007 Izuchi et al. ..... 381/174
7,292,696 B2 * 11/2007 Saeki et al. ..... 381/175
2006/0120544 A1 * 6/2006 Akino ..... 381/174
2006/0177083 A1 * 8/2006 Sjursen et al. ..... 381/322
2008/0137885 A1 * 6/2008 Yamamoto et al. ..... 381/174

FOREIGN PATENT DOCUMENTS

| | | |
|---|---|---|
| JP | 61-276400 | 12/1986 |
| JP | 6-339192 | 12/1994 |
| JP | 3011048 | 5/1995 |
| JP | 9-036581 | 2/1997 |
| JP | 11-155197 | 6/1999 |

* cited by examiner

*Primary Examiner*—Suhan Ni
*Assistant Examiner*—Jasmine Pritchard
(74) *Attorney, Agent, or Firm*—Oblon, Spivak, McClelland, Maier & Neustadt, L.L.P.

(57) ABSTRACT

A capacitor microphone unit comprises a diaphragm vibrated in response to voices, a fixed electrode facing the diaphragm, an insulator, a circuit board, and a cylindrical unit case housing the foregoing components. An open end of the cylindrical unit case is folded inward, and holds a peripheral edge of the circuit board, the folded part functioning as a crimp; a ground wiring pattern is present on the peripheral edge of the circuit board, and is perforated at a plurality of positions along the peripheral edge of the circuit board; and the circuit board is pressed by the crimp at a plurality of positions.

4 Claims, 6 Drawing Sheets

CAPACITOR MICROPHONE UNIT

CROSS REFERENCE TO RELATED APPLICATIONS

This invention is based upon and claims the benefit of priority from prior Japanese Patent Application No. 2004-252178 filed on Aug. 31, 2004; the entire contents of which are incorporated by reference herein.

BACKGROUND OF THE INVENTION

1. Field of the Invention

This invention relates to a capacitor microphone unit, and more particularly to a capacitor microphone unit in which an open end of a unit case is crimped in order to fixedly attach and reliably shield components.

2. Description of the Related Art

An existing capacitor microphone unit will be outlined with reference to FIG. 1 (related to the present invention) of the accompanying drawings. A cylindrical case 10 has a bottom, is formed by the drawing compound process, and houses a ring 26, a diaphragm 20, a fixed electrode 22, an insulator 24 and a circuit board 30, all of which are inserted in the named order. A peripheral top edge of the cylindrical case 10 is folded inward, and is crimped. This part is called the "crimp 14". The crimp 14 firmly holds a peripheral edge of the circuit board 30, so that the components are fixed in the cylindrical case 10. In FIG. 1, the cylindrical case 10 is shown upside down. A plurality of circular openings 12 are formed on the bottom of the cylindrical case 10. An inner peripheral edge of the circuit board 30 holds a peripheral edge of the insulator 24. The insulator 24 holds the fixed electrode 22 via its inner surface. A periphery of the diaphragm 20 is sandwiched between an outer periphery of the fixed electrode 22 and the ring 26. There is a space between the diaphragm 20 and the fixed electrode 22 except for the peripheral edge of the fixed electrode 22. Hence, the diaphragm 20 is vibrated by voices getting into the cylindrical case 10.

The crimp 14 of the cylindrical case 10 appropriately presses the components and makes them immovable. An evaporated surface of the diaphragm 20, the ring 26 and the case 10 are electrically connected to a ground wiring pattern of the circuit board 30. This is effective in blocking noise caused by high frequency signals. The capacitor microphone shown in FIG. 1 is of an electret type, in which electric charges are semi-permanently held on the diaphragm 20. The diaphragm 20 and the fixed electrode 22 are formed as a capacitor. A capacitance of the capacitor varies with vibrations, so that electric charges are discharged or introduced. Hence, an amount of electric charges also changes, so that a minute current is produced in response to vibrations of the diaphragm 20. The minute current is converted into a voltage signal at high resistance. The voltage signal is converted to low impedance by an amplifier, and is discharged outward. The amplifier is included in the circuit board 30, and is realized by a field effect transistor 28 (FET) functioning as an impedance converter.

At present, a number of capacitor microphones are very popular in order to convert voices into electric signals in a cellular phone using high frequency signals. High frequency signals entering into a microphone unit are detected by the impedance converter constituted by the FET 28, are converted into audio frequency signals, and are mixed as noise into an audio signal converted by the microphone unit.

The crimp 14 of the cylindrical case10 is brought into pressure contact with the ground wiring pattern of the circuit board 30 in order to accomplish an electric connection, and protects the microphone unit against noise caused by high frequency signals. This feature is inevitable in cellular phones or the like using high frequency signals, and is very effective in protecting capacitor microphones against noise caused by high frequency signals.

The printed circuit board 30 structured as shown in FIG. 6, which shows a wiring pattern on an outer surface. Most of the wiring pattern is used as a ground wiring pattern 60, which surrounds not only the remaining wiring patterns but also the periphery of the printed circuit board 30. The ground wiring pattern 60 is flat as a whole.

However, when the ground wiring pattern 60 is flat, pressure applied by the crimp 14 is dispersed, and the crimp 14 is in partial contact with the ground wiring pattern 60. In an extreme case, the crimp 14 is only in point contact with the ground wiring pattern 60. Therefore, high frequency signals will not be sufficiently blocked, and may enter into the microphone unit and cause noise. Therefore, it is very difficult to check with eyes whether or not the crimp 14 and the ground wiring pattern 60 are in partial contact with each other since contact is very minute. Further, it is also very difficult to measure a resistance value using a tester because the resistance itself is very minute.

Japanese Patent Laid-Open Publication No. Hei 11-155,197 describes a capacitor microphone unit. In the publication, a shielded case houses a circuit board block at one end thereof, and a support of a capacitor microphone picking up sound pressure as a variation of capacitance is positioned at the other end thereof. The support, capacitor microphone and circuit board block are held in unison in the shielded case. The circuit board block includes a grounding pattern which is conductively connected to the shielded case. An elastic microphone cap is attached to an outer surface of the shielded case. A conductive tape is attached on the outer surface of the shielded case, and is connected to the grounding pattern via a part thereof.

In the foregoing publication, the capacitor microphone unit includes the shielded case in which the capacitor microphone, support and circuit board block are crimped. However, the crimped part of the shielded case and the ground wiring pattern of the circuit board block are not directly pressed. The ground wiring pattern and the outer surface of the shielded case are made conductive via the conductive tape. Electrical conduction is unstable between the ground wiring pattern and the shielded case, so that the capacitor microphone is susceptible to external high frequency signals.

There has been proposed a microphone unit in which a microphone unit case has its open end folded in order to hold an outer periphery of a circuit board (refer to Japanese Patent Laid-Open Publication No. Hei 06-339,192).

The present invention has been contemplated in order to overcome problems of the related art.

SUMMARY OF THE INVENTION

According to the invention, there is provided a capacitor microphone unit comprising a diaphragm vibrated in response to voices, a fixed electrode facing the diaphragm, an insulator, a circuit board, and a cylindrical unit case housing the foregoing components. An open end of the cylindrical unit case is folded inward, and holds a peripheral edge of the circuit board, the folded part functioning as a crimp; a ground wiring pattern is present on the peripheral edge of the circuit board, and is perforated at a plurality of positions along the peripheral edge of the circuit board; and the circuit board is pressed by the crimp at a plurality of positions.

DETAILED DESCRIPTION OF THE INVENTION

Figure 1:
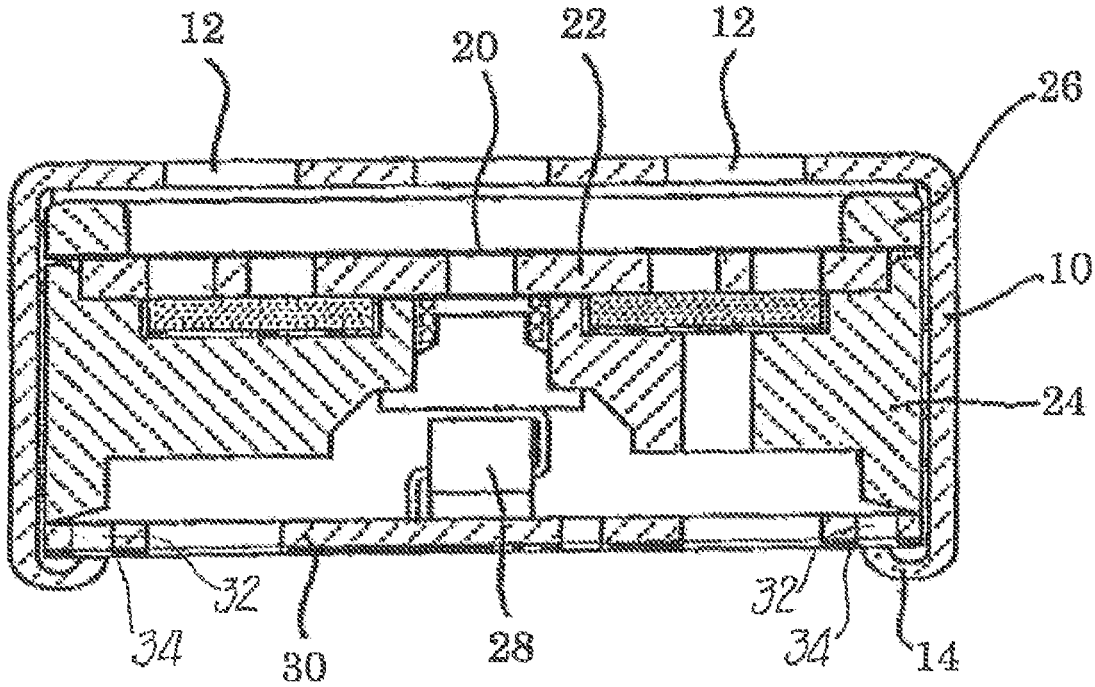
FIG. 1 is a cross section of a microphone unit according to one embodiment of the invention.
Figure 2:
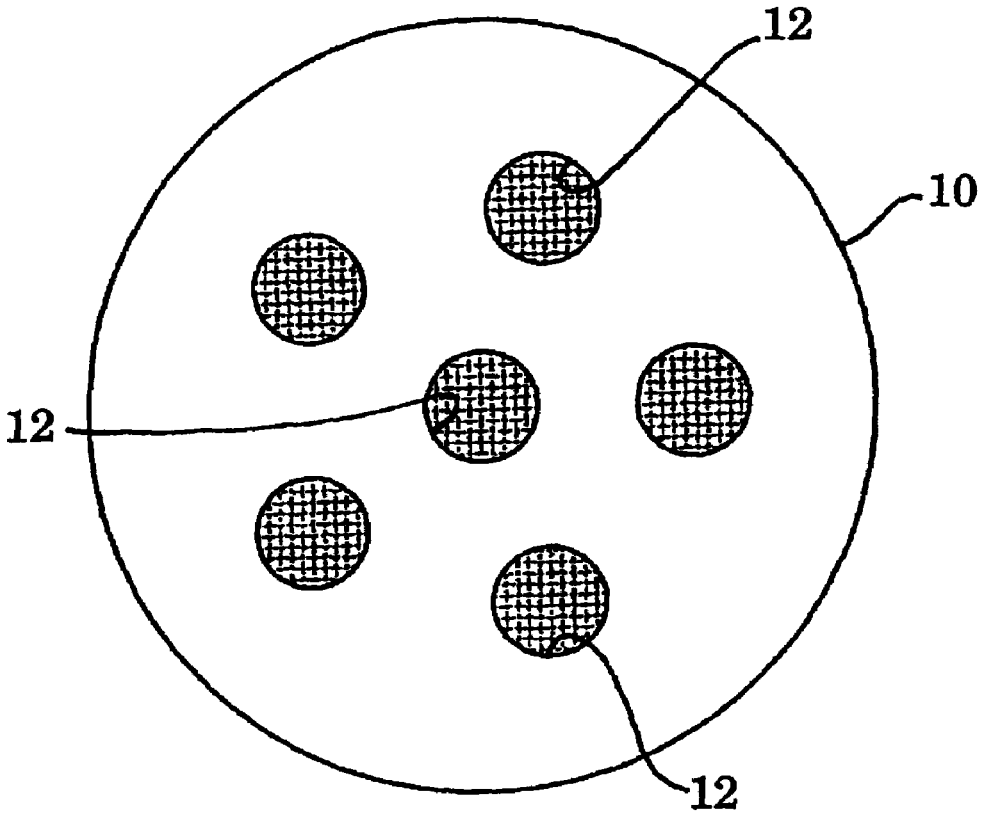
FIG. 2 is a top plan view of the microphone unit.
Figure 3:
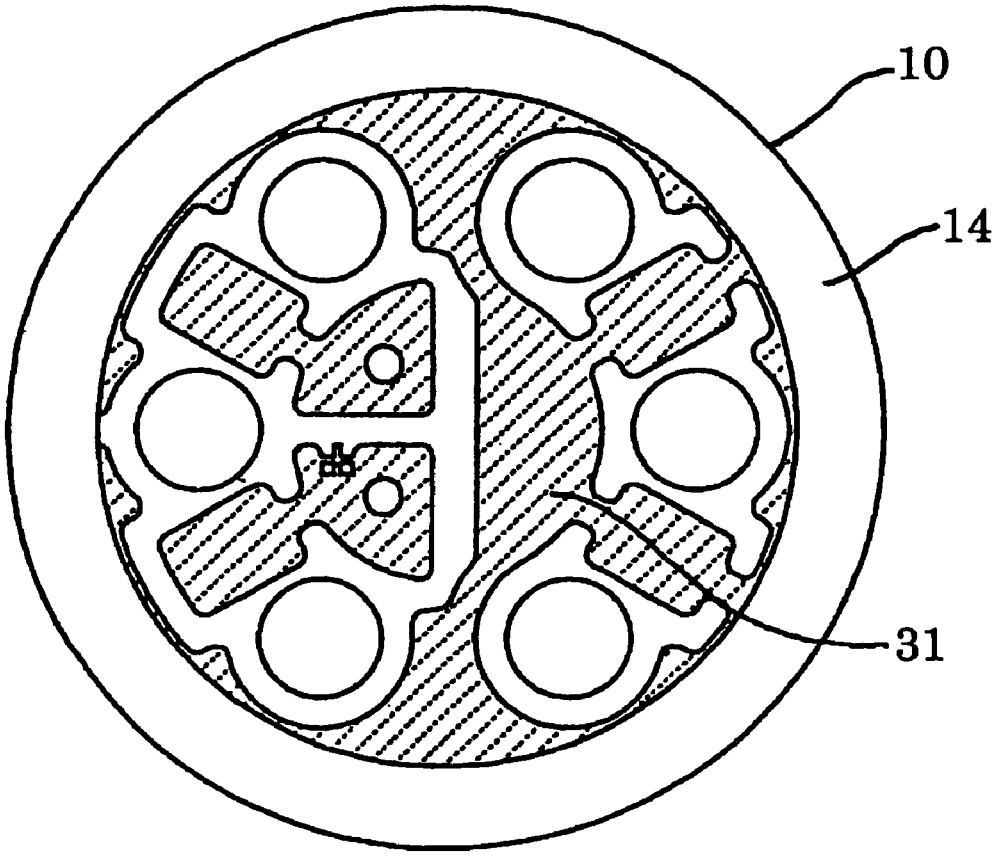
FIG. 3 is a bottom plan view of the microphone unit.

Referring to FIG. 1, FIG. 2 and FIG. 3, a microphone unit case 10 is prepared by the drawing compound process, houses a ring 26, a diaphragm 20, a fixed electrode 22, an insulator 24, and a printed circuit board 30, all of which are inserted via an open end of the microphone unit case 10 (called the "case 10"). The printed circuit board 30 is circular. The open end of the microphone unit case 10 is folded inward and is pressed as shown in FIG. 1 and FIG. 2. The folded and pressed part is called the "crimp 14". The crimp 14 holds a peripheral edge of the printed circuit board 14, so that the foregoing components are reliably housed in the case 10. In FIG. 1, the case 10 is shown upside down. Circular openings 12 are formed in the bottom in order to receive voices arriving into a microphone unit. An inner peripheral edge of the circuit board 30 holds an outer peripheral edge of the insulator 24. An inner peripheral edge of the insulator 24 holds the fixed electrode 22. A peripheral edge of the diaphragm 20 is engaged between the peripheral edge of the fixed electrode 22 and the ring 26, so that the fixed electrode 22 faces with the diaphragm 20. There is a space between the diaphragm 20 and the fixed electrode 22 except for the peripheral edge of the fixed electrode 22. The diaphragm 20 vibrates in response to voices arriving in the case 10.

The crimp 14 of case 10 holds the components immovable by applying appropriate pressure to them, and electrically connects an evaporated surface of the diaphragm 20, the ring 26 and the case 10 to a ground wiring pattern of the printed circuit board 30. In short, the crimp 14 functions to block noise caused by external high frequency signals. The capacitor microphone shown in FIG. 1 is of an electret type, in which electric charges are semi-permanently maintained on the diaphragm 20. The diaphragm 20 and the fixed electrode 22 are formed as a capacitor. Capacitance of the capacitor varies with vibrations, so that electric charges are discharged and introduced. Hence, an amount of electric charges also changes, so that a minute current is produced in response to vibrations of the diaphragm 20. The minute current is converted into a voltage signal at high resistance. The voltage signal is converted to a low impedance by an amplifier, and is discharged outward. The amplifier is included in the circuit board 30, is realized by a field effect transistor 28 (FET), and functions as an impedance converter.

Figure 4:
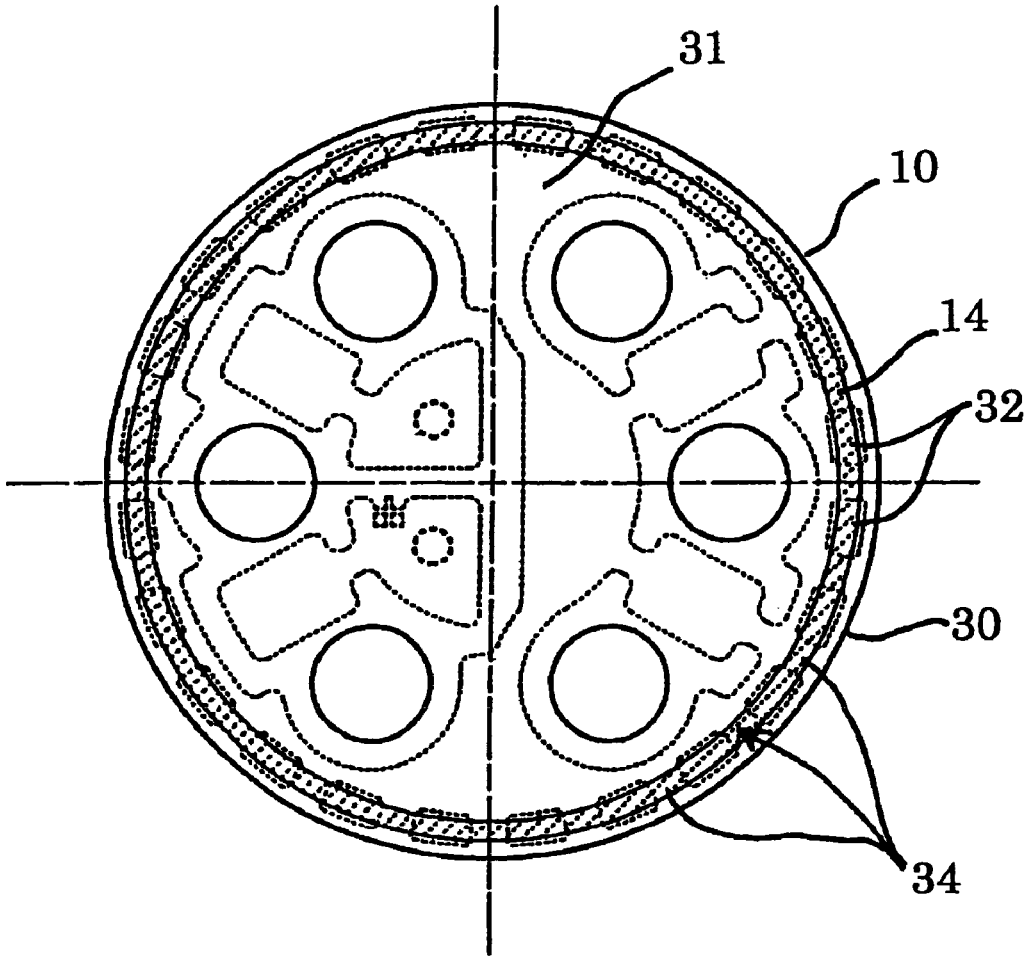
FIG. 4 is a schematic view showing parts which are pressed by a crimp of a microphone unit case.
Figure 5:
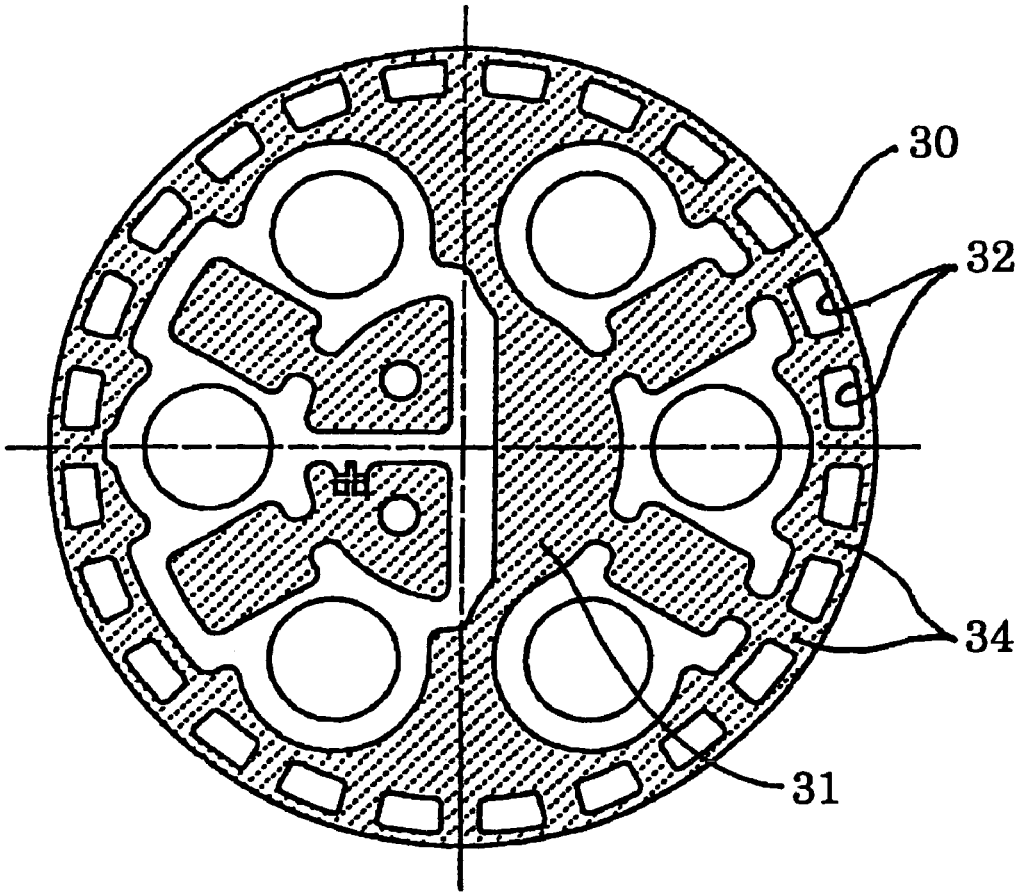
FIG. 5 is a bottom plan view showing a printed circuit board and a wiring pattern on an outer surface thereof.
Figure 6:
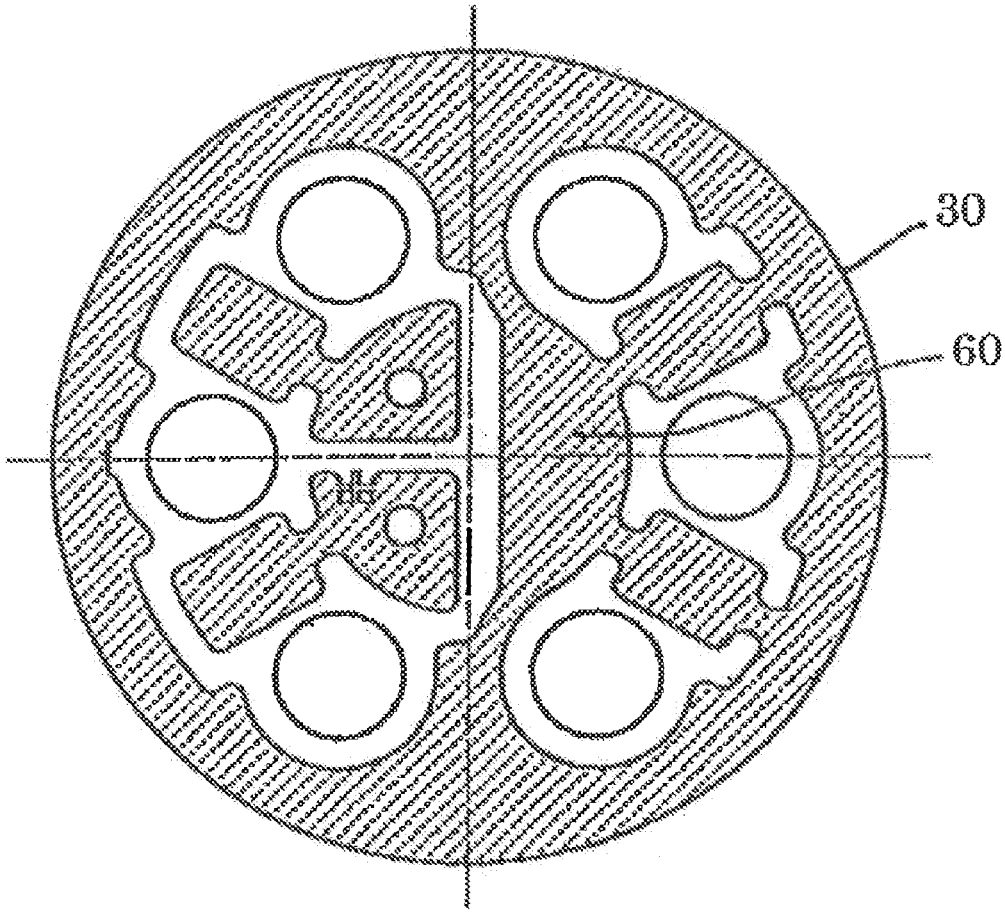
Fig. 6 PRIOR ART
FIG. 6 is a bottom plan view showing a printed circuit board of a microphone unit of the prior art and a wiring pattern on an outer surface.

FIG. 4 and FIG. 5 shows a wiring pattern on the outer surface of the printed circuit board 30. The present invention is characterized by the wiring pattern. A ground wiring pattern 31 occupies most of the wiring pattern, surrounds the other wiring patterns, and extends along the peripheral edge of the printed circuit board 30. The ground wiring pattern 31 is flat, and is perforated at a plurality of positions along the peripheral edge of the printed circuit board 30, and is pressed by the crimp 14 at a plurality of positions. In FIG. 4 and FIG. 5, reference numeral 32 denotes perforated positions, and reference numeral 34 denotes positions where the ground wiring pattern is pressed by the crimp 14.

Specifically, the parts 32 and the parts 34 are alternately present and are equally spaced on the ground wiring pattern 31 of the printed circuit board 30.

The open end of the case 10 is folded inward, and is pressed to the peripheral edge of the printed circuit board 30. Further, the printed circuit board 30 is pressed by the crimp 14 at equally spaced positions 34. This means that pressure is applied to limited positions on the printed circuit board 30. The pressure per unit area is increased, which is effective in reliably making the case 10 and the ground wiring pattern 31 conductive.

Even if pressure is not always uniformly applied to the printed circuit board 30 at the positions 34 by the crimp 14, the perforated positions 32 of the ground wiring pattern 31 can absorb unequal pressure. This enables the crimp 14 and ground wiring pattern 31 to be conductive at a plurality of positions.

Therefore, the microphone unit can be reliably shielded, which is effective in blocking electromagnetic waves entering into the microphone unit, and preventing noise from being mixed into audio signals.

The ground wiring pattern 31 surrounds not only the remaining wiring patterns but also the peripheral edge of the printed circuit board 30, which is effective in shielding audio signal terminals, and preventing noise.

In the foregoing embodiment, the case 10 is pressed by the crimp 14 at a plurality of equally spaced positions 34 along the peripheral edge of the printed circuit board 30. Alternatively, the positions 34 may be unequally spaced.

The present invention is applicable not only to a microphone unit of a cellular phone but also to a variety of appliances. Especially, when used in an environment where electromagnetic waves fly about, the microphone unit is slow to be affected, and is protected against noise.

What is claimed is:

1. A capacitor microphone unit, comprising:

a diaphragm vibrated in response to voices;

a fixed electrode facing the diaphragm;

an insulator;

a circuit board; and a cylindrical unit case housing the foregoing components, wherein an open end of the cylindrical unit case is folded inward forming a crimp, and the crimp holds and presses a peripheral edge of the circuit board, a ground wiring pattern is present on the peripheral edge of the circuit board, and the circuit board is perforated at a plurality of positions along the peripheral edge of the circuit board, such that a perforated portion of the peripheral edge is held by the crimp;

and the circuit board is pressed by the crimp at a plurality of positions.

2. The capacitor microphone unit of claim 1, wherein the ground wiring pattern is perforated at equally spaced positions along the peripheral edge of the circuit board, and the circuit board is pressed by the crimp at equally spaced positions.

3. The capacitor microphone unit of claim 1, wherein the ground wiring pattern surrounds other wiring patterns.

4. The capacitor microphone unit of claim 1, wherein the ground wiring pattern surrounds the peripheral edge of the circuit board.

* * * * *